US011407605B2

(12) United States Patent
Ruiz et al.

(10) Patent No.: US 11,407,605 B2
(45) Date of Patent: Aug. 9, 2022

(54) AIR-BASED PHOTORECEPTOR SHEET STRIPPER

(71) Applicant: Xerox Corporation, Norwalk, CT (US)

(72) Inventors: Erwin Ruiz, Rochester, NY (US); Rachel L. Tanchak, Rochester, NY (US); Roberto A. Irizarry, Rochester, NY (US); Carlos M. Terrero, Ontario, NY (US); Glenn D. Batchelor, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 451 days.

(21) Appl. No.: 16/704,603

(22) Filed: Dec. 5, 2019

(65) Prior Publication Data

US 2021/0171307 A1 Jun. 10, 2021

(51) Int. Cl.

| | |
|---|---|
| ***B65H 29/56*** | (2006.01) |
| ***B65H 29/24*** | (2006.01) |
| ***G03G 15/00*** | (2006.01) |

(52) U.S. Cl.

CPC ..... *B65H 29/56* (2013.01); *B65H 29/248* (2013.01); *G03G 15/6529* (2013.01); *B65H 2801/06* (2013.01)

(58) Field of Classification Search

CPC ..... B65H 29/245; B65H 29/248; B65H 29/56
See application file for complete search history.

(56) References Cited

U.S. PATENT DOCUMENTS

| | | | | |
|---|---|---|---|---|
| 3,804,401 | A | 4/1974 | Stange | |
| 3,895,793 | A | 7/1975 | Bigenwald | |
| 4,050,691 | A * | 9/1977 | Ito | G03G 15/6532 271/900 |
| 4,060,235 | A | 11/1977 | Weikel, Jr. | |
| 4,073,585 | A * | 2/1978 | Kobayashi | G03G 15/6532 271/902 |
| 4,420,152 | A * | 12/1983 | Miyashita | B65H 29/56 271/309 |
| 6,104,000 | A * | 8/2000 | Aslam | B65H 29/54 399/330 |
| 8,320,807 | B2 * | 11/2012 | Onodera | G03G 15/2028 399/323 |

(Continued)

FOREIGN PATENT DOCUMENTS

| | | |
|---|---|---|
| GB | 1564859 A | 4/1980 |
| WO | 2005047001 A1 | 5/2005 |

*Primary Examiner* — Patrick Cicchino
(74) *Attorney, Agent, or Firm* — Gibb & Riley, LLC

(57) ABSTRACT

Printing apparatuses include (among other components) a photoreceptor (that is adapted to contact and transfer marking material to a printing side of sheets of media), a transport belt adjacent the photoreceptor, a baffle, and an air outlet. The sheets of media are moved by the photoreceptor across a gap to the transport belt in a "processing direction." The baffle is adjacent the back side of the sheets of media (the side that is opposite to the printing side of the sheets of media). The air outlet is also positioned adjacent the back side of the sheets of media, and the air outlet is adapted to direct a stream of air along the baffle and between the baffle and the back side of the sheets of media to lift the sheets of media off the photoreceptor without damaging the sheets of media or disturbing the unfused marking material thereon.

20 Claims, 9 Drawing Sheets

(56) References Cited

U.S. PATENT DOCUMENTS

| | | | | |
|---|---|---|---|---|
| 8,433,229 | B2 * | 4/2013 | Murakami | G03G 15/6573 399/92 |
| 8,794,624 | B2 | 8/2014 | Herrmann | |
| 8,818,250 | B2 * | 8/2014 | Wazumi | G03G 15/2028 399/323 |
| 9,610,780 | B2 * | 4/2017 | La Vos | B65H 29/242 |
| 9,758,334 | B1 | 9/2017 | Herrmann | |
| 10,981,742 | B2 * | 4/2021 | Terrero | B65H 29/70 |
| 2005/0156377 | A1 * | 7/2005 | Jacobs | G03G 15/2028 271/309 |
| 2007/0206981 | A1 * | 9/2007 | Amico | G03G 15/2028 399/323 |
| 2016/0152045 | A1 * | 6/2016 | La Vos | B65H 5/224 271/3.21 |

* cited by examiner

AIR-BASED PHOTORECEPTOR SHEET STRIPPER

BACKGROUND

Systems and methods herein generally relate to printing devices that use photoreceptors and more particularly to devices and methods that strip sheets of print media from the photoreceptors.

Many types of printing devices use photoreceptors to transfer marking material to sheets of print media. Photoreceptors are generally charged surfaces (e.g., belts, drums, etc.) to which a pattern of marking material, usually in powder form (toner, dry inks, etc.), is transferred. In turn, the photoreceptor eventually makes contact with sheets of print media and transfers the pattern of marking material onto the print media. After the print media is separated from the photoreceptor, the print media travels to some form of device that permanently attaches and bonds the marking material to the print media, such as a heated fuser, pressure roller, etc. Often, the print media is transferred from the photoreceptor to a vacuum transport belt that transports the sheets of print media containing the marking material to the fusing/bonding device.

However, it can sometimes be difficult to separate or "strip" the sheets of print media from the photoreceptor. Therefore, various stripping devices ("strippers") have been developed for this task. Commonly, electrical charge producing devices (e.g., detack charge devices, located on the opposite side of the photoreceptor that contacts the sheets of print media) generate a repelling charge that pushes the sheets of print media off the photoreceptor surface. Additionally, mechanical strippers (devices with a narrowed edge) can be utilized to help physically peel the sheets of print media from the surface of the photoreceptor.

Unfortunately, many efforts to remove the sheets of print media from the photoreceptor can be unsuccessful. Specifically, the sheets of print media may remain on the photoreceptor, which can cause jams with subsequent sheets print media that are placed in contact with the photoreceptor. Additionally, the leading edges of the sheets of print media may be damaged when removed from the photoreceptor, resulting in jams downstream, as the sheets are subsequently fed into later-used, downstream processing devices.

Alternatively, the mechanical and stripping devices may disturb the pattern of marking material on the sheets of print media before the sheets of print media reach the fusing devices. This is especially problematic because the powder-based marking material is especially delicate as it exists on the sheets of print media until the marking material is permanently bonded onto the sheets of print media. Therefore, it is quite easy to disturb the unfused powder-based marking material and thereby create image quality defects when removing the sheets of print media from the photoreceptor.

In one example of difficulties encountered while removing print media from photoreceptors, ultra-lightweight media applications (such as pharmaceutical inserts) have a drastically reduced sheet stiffness, which makes belt stripping very challenging. Many printing devices rely upon the media's own beam strength or stiffness to self-strip from the photoreceptor. Various characteristics ("system noises") such as grain orientation, image to sheet leading edge distance, detack charges, and environmental conditions, reduce the media's beam strength, resulting in an increase of stripping jams and paper damage (e.g., "dog ears").

One potential process for stripping media from photoreceptors is to increase the detack charge; however, such will not improve the media stiffness, which is lacking in ultra-light weight media. Additionally, excessive detack charge might disturb the pattern of marking material on the sheet, resulting in unacceptable image quality defects. Alternatively, the stripping roll diameter might be reduced to improve the media self-stripping; however, such will drastically reduce belt life by increasing cracking of the belt.

SUMMARY

To address the foregoing, various printing apparatuses are presented herein that include (among other components) a photoreceptor (that is adapted to contact and transfer marking material to a printing side of sheets of media), a transport belt adjacent the photoreceptor, a baffle, and an air outlet. The sheets of media are moved by the photoreceptor across a gap to the transport belt in a "processing direction." The baffle is adjacent the back side of the sheets of media (the side that is opposite to the printing side of the sheets of media). The air outlet is also positioned adjacent the back side of the sheets of media, and the air outlet is adapted to direct a stream of air along the baffle and between the baffle and the back side of the sheets of media.

Stated differently, such apparatuses include (among other components) a frame, a transfer surface (e.g., photoreceptor or comparable device), a transport device (e.g., vacuum belt, etc.), a curved baffle, and an air outlet, each of which is directly or indirectly connected to the frame. The transfer surface is adapted to contact and transfer marking material to the printing side of sheets of media. The transport device is adjacent the transfer surface, and a gap is present between the transfer surface and the transport device. The sheets of media are moved by the transfer surface across the gap to the transport device in the processing direction; however, sometimes the sheets remain attached to the transfer surface and need to be stripped from the transfer surface. The baffle and the air outlet are adjacent the back side of the sheets of media and the air outlet is adapted to direct a stream of air along the baffle and between the baffle and the back side of the sheets of media to strip the sheets from the transfer surface and feed the sheets to the transport device.

The baffle has a convex curved surface facing the back side of the sheets of media. The air outlet is positioned relative to the convex curved surface of the baffle to direct the stream of air along the convex curved surface of the baffle. Also, an optional sheet deflector can be part of, or connected to, the baffle. The sheet deflector includes air slots through which the stream of air can pass, but the sheets of media cannot, which directs the sheets of media from the surface of the baffle to the transport device. The sheet deflector is therefore positioned between the baffle and the transport belt.

The air outlet is adapted to begin outputting the stream of air when the leading edge of the sheets of media is adjacent the lowest point of the baffle where there is maximum lifting force and to stop outputting the stream of air when the leading edge of the sheets of media contacts the transport device. Also, a processor can be included to control the air outlet to adjust the force and duration of the stream of air based on the beam strength of the sheets of media.

Additionally, such devices can include a mechanical stripper device. The mechanical stripper device is adjacent the transfer surface on the printing side of the sheets of media. Also, the mechanical stripper device is positioned to contact the sheets of media to help the sheets of media separate from the transfer surface. If a mechanical stripper device in used, the air outlet can be adapted to output the stream of air beginning when the leading edge of the sheets of media reaches the lowest point of the baffle until when the leading edge of the sheets of media reaches the mechanical stripper device.

Various methods herein perform processing, including transferring marking material to a printing side of sheets of media using a photoreceptor, moving the sheets of media from the photoreceptor across a gap to a transport belt in a processing direction, and directing a stream of air toward a baffle using an air outlet. The baffle is adjacent the back side of the sheets of media that is opposite to the printing side of the sheets of media. Also, the process of directing the stream of air directs the stream of air along a convex curved surface of the baffle.

The process of directing the stream of air can be performed by beginning outputting the stream of air when the leading edge of the sheets of media is adjacent the lowest point of the baffle and stopping outputting the stream of air when the leading edge of the sheet of media contacts the transport device, or when the leading edge of the sheet of media reaches an optional mechanical stripper device. Also, such methods can prevent the sheets of media from following the full surface of the baffle using sheet deflector of the baffle facing the transport belt.

In some embodiments, these methods can automatically determine the beam strength of the sheets of media. This allows such methods to control the air outlet to adjust the force and duration of the stream of air based on the beam strength of the sheets of media so as to minimize the chance of disturbing the marking material.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1A:
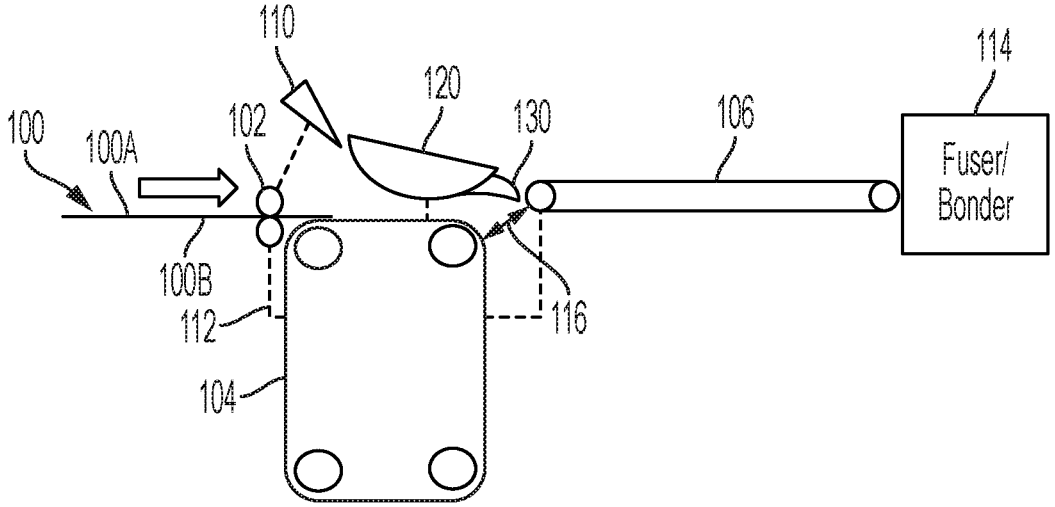
FIGS. 1A-2F are cross-sectional schematic diagrams illustrating stripping devices herein.

As mentioned above, it is easy to create image quality defects or damage the sheets when removing the sheets of print media from the photoreceptor. In view of this, the structures and methods discussed below use a curved baffle and airflow between the baffle and the back side of the print media to remove the print media from the photoreceptor without damaging the print media or affecting the marking material on the printing side (the opposite side from the stream of air) of the print media.

The curved baffle and airflow on the back side of the print media discussed below utilizes the "Coanda" effect in order to compensate for the lack of beam strength or mechanical stiffness of the print media (such as ultra-lightweight media). The Coanda effect is the tendency of a jet of air or fluid to follow an adjacent flat or curved surface and to entrain items from the surroundings as a result of a region of lower pressure that develops. In other words, the air passing over the curved baffle develops an area of lower pressure that gently lifts the back side of the sheets of media from the photoreceptor, without damaging the sheets or disturbing the marking material on the opposite side of the sheets. By compensating for the lack of media stiffness, this air assist overpowers the media's tendency to stay on the photoreceptor, as well as the system's noises, such as high humidity, paper grain orientation, or image location. The result is an improvement on the stripping latitude without sacrificing image quality or belt life.

The curved baffle is located proximate to the photoreceptor and the stream of air passes along the contour of the curved baffle creating the lower pressure area from the Coanda effect. The low-pressure area lifts the media and provides a rigid surface in which will increases the stripping latitude of the media. The curved baffle is located such that the force induced by the Coanda effect strips the sheet from the photoreceptor belt and moves the sheets onto the vacuum transport downstream.

FIGS. 1A-2F are cross-sectional schematic diagrams illustrating various devices herein. These devices include (among other components) what is generically referred to herein as a "frame" 112 (shown using broken lines in FIGS. 1A-2F). The frame 112 can comprise many different components of the apparatus, which are elements of the apparatus and which are directly or indirectly connected to each other. Thus, the frame herein can include any or all of the various elements that physically support the enumerated components discussed below. In the attached drawings, identification numeral 112 is used to indicate the different items that can be considered this generically defined "frame." All the individual components discussed below are in a fixed location (even though many of the following components move, rotate, etc., in their fixed locations relative to the frame 112) and therefore all the following components are directly or indirectly connected to the frame 112 in some way.

As shown in FIG. 1A, devices herein include a transfer surface 104 (e.g., photoreceptor or equivalent), a transport device 106, a baffle 120, an air outlet 110, each of which is directly or indirectly connected to the frame 112. The air outlet 110 is connected to any type of well-known pressurized air source (e.g., fan, air pump, etc., not shown) and is controllable to selectively produce a stream of air. FIG. 1A also illustrates nip rollers 102 that feed the sheets of media 100 to the transfer surface 104.

The transfer surface 104 is adapted to contact and transfer marking material to a "printing side" 100B of sheets of media 100. Many different types of well-known marking material transfer surfaces can be used to place the pattern of marking material on the transfer surface 104. The transport device 106 can be any type of well-known device that moves sheets of media (e.g., nip rollers, slides, guides, belts) and in one example is a vacuum belt that contains vacuum openings that provide suction to maintain the sheets on the transport device 106.

The transport device 106 is adjacent the transfer surface 104, and a gap (116, FIG. 1A) is present between the transfer surface 104 and the transport device 106. The sheets of media 100 are moved by the transfer surface 104 across the gap 116 to the transport device 106 in the processing direction. The transport device 106 moves the sheets of media 100 to a fusing/bonding device 114 that fuses and/or bonds the loose powder marking material present on the sheets of media 100 permanently to the sheets of media 100 using, for example, heat and/or pressure, chemical binding agents, etc.

The baffle 120 and the air outlet 110 are adjacent a "back side" 100A of the sheets of media 100. The back side 100A of the sheets of media 100 is the opposite side from the printing side 100B. The sheets of media pass between the baffle 120 and the transfer surface 104. Also, an optional sheet deflector 130 can be part of, or connected to, the baffle 120.

As noted above, the sheets of media 100 are moved by the transfer surface 104 across the gap 116 to the transport device 106 in the processing direction; however, sometimes the sheets 100 remain attached to the transfer surface 104 and need to be stripped from the transfer surface 104. The curved baffle 120 is located proximate to the transfer surface 104 and the stream of air passes along the contour of the curved baffle 120 creating a relatively lower pressure area (relative to the surrounding space) as a result of the Coanda effect. This low-pressure area lifts the media 100 off the transfer surface 104. The curved baffle 120 is located such that the lifting force induced by the Coanda effect strips the sheet 100 from the photoreceptor belt 104 and onto the vacuum transport 106.

Figure 1B:
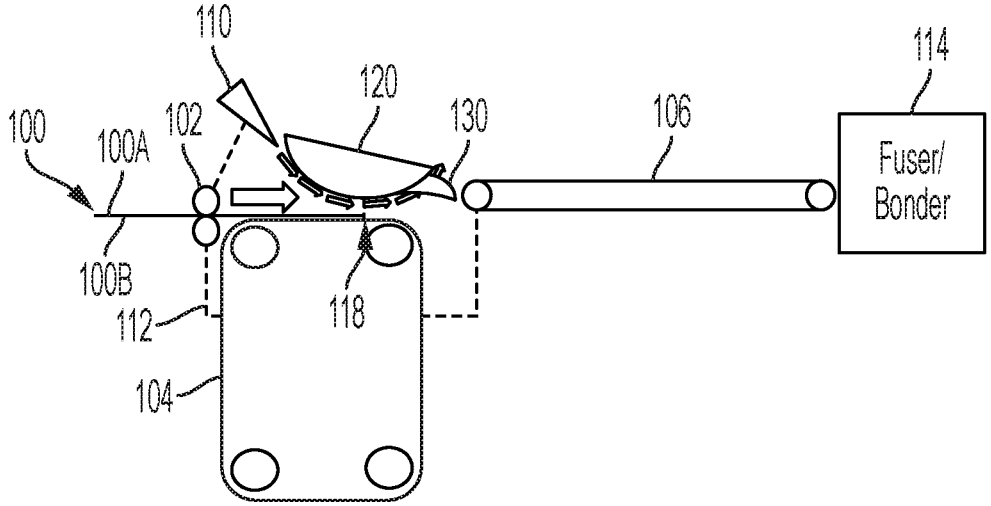

More specifically, as shown in FIG. 1B, the air outlet 110 is adapted to direct a stream of air (stream of air shown using block arrows in the drawings) along the baffle 120 and between the baffle 120 and the back side 100A of the sheets of media 100. Note that while the rotation of components within the machine and the movement of sheets and other elements may cause some air movement around the curved baffle 120 and transfer surface 104, this is distinguished from the higher-pressure, higher-speed forced air movement of the stream of air discussed herein and illustrated in the drawings using the block arrows. More specifically, the stream of air is generated using pressurized air that is at a pressure greater than one atmosphere (e.g., 20-2000 psi) and the stream of air moves at speeds higher than random air movement within the device (e.g., 0.1-10 m/s).

The speed of the stream of air is adjusted and controlled to provide only enough force to lift the sheet of media 100 off the transfer surface 104, without additional force. The speed/pressure of the stream of air is minimized so as to minimize the risk that the stream of air might disturb the unfused marking material on the printing side 100B of the sheet of media 100. Providing the stream of air to the back side 100A avoids disturbing the unfused marking material on the printing side 100B itself; and minimizing the force and duration of the stream of air further contributes to not disturbing the unfused marking material.

Figure 1C:
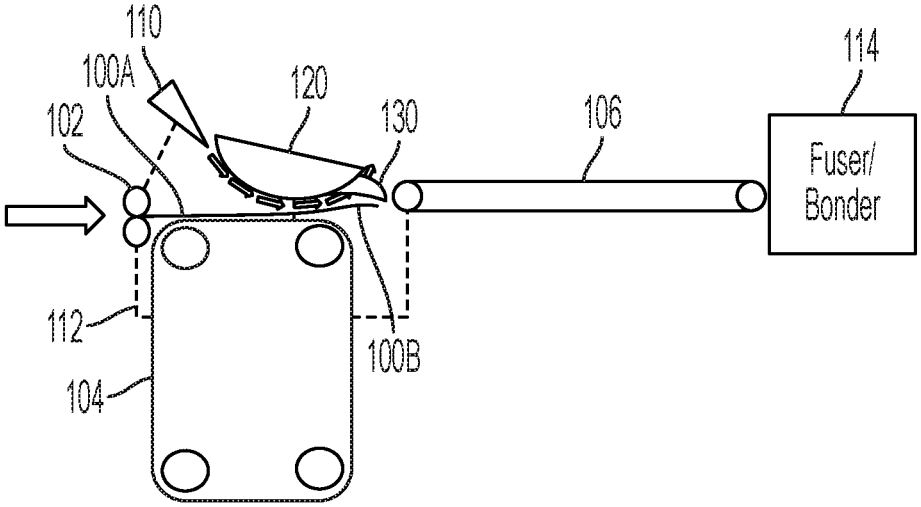

As shown in FIG. 1C, the roller nips 102 and the rotational movement of the transfer surface 104 continue to move the sheet of media 100 in the processing direction while the air outlet 110 continues to direct the stream of air along the curved surface of the baffle 120, which begins to lift the leading edge of the sheet of media 100 off the transfer surface 104.

The lifting force will be greatest in the area where the surface of the curved baffle 120 is closest to the transfers surface 104 (e.g. where the smallest gap between the baffle 120 and the transfer surface 104 is located) and that point is referred to herein as the "maximum lifting point" that is identified in some drawings using identification numeral 118. Therefore, while the drawings show one example of positional relationships between the various components, the components herein can have different positional relationships to optimize the lifting force for specific types of media, specific machine characteristics, etc. Therefore, the shape of the curved baffle 100 as well as the position of the curved baffled 120 relative to the gap 116, the transfer surface 104, the transport device 106, etc., can all be adjusted to relocate the position of maximum lifting point 118 so that the maximum lifting point 118 is optimized for a given machine and sheet-type combination.

Figure 1D:
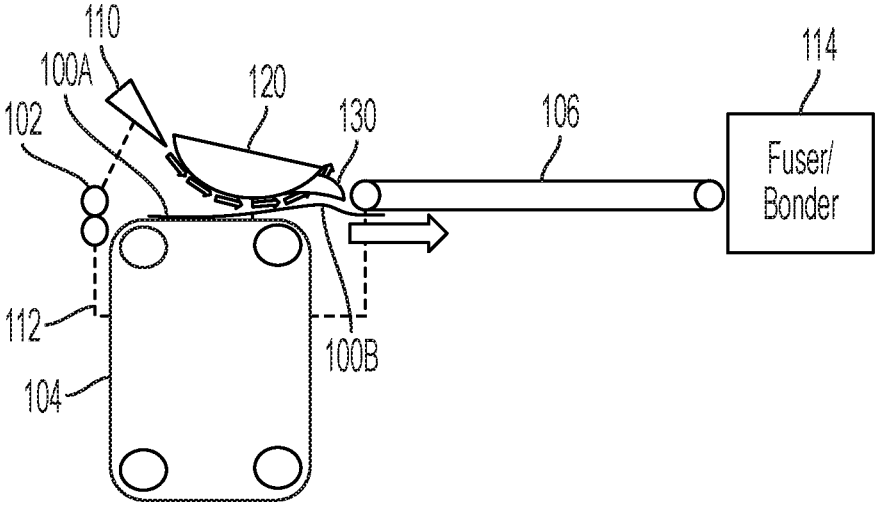

This process continues, which moves the sheet of media 100 even further in the processing direction, as shown in FIG. 1D. The low-pressure area lifting force produced by the stream of air moving along the curved surface of the baffle 120 continues to lift the sheet of media 100 from the transfer surface 104 and move the sheet of media 100 toward the transport device 106. Eventually, as shown in FIG. 1D, the sheet of media reaches the transport device 106. Once the sheet of media 100 reaches the transport device 106, the air outlet 110 stops outputting the stream of air. Next as shown in FIGS. 1E and 1F, the transport device 106 holds and moves the sheet of media 100 in the processing direction, eventually moving the sheet of media 100 to the fuser/bonder 114.

Figure 1E:
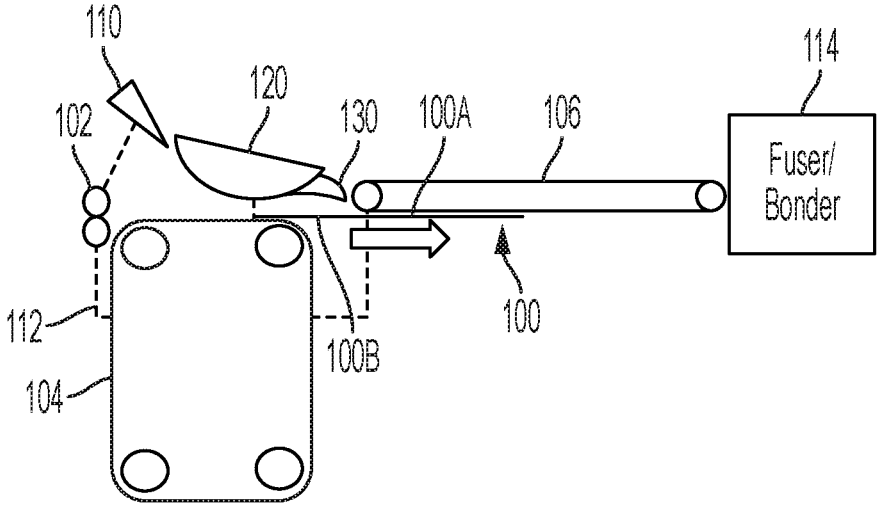
Figure 1F:
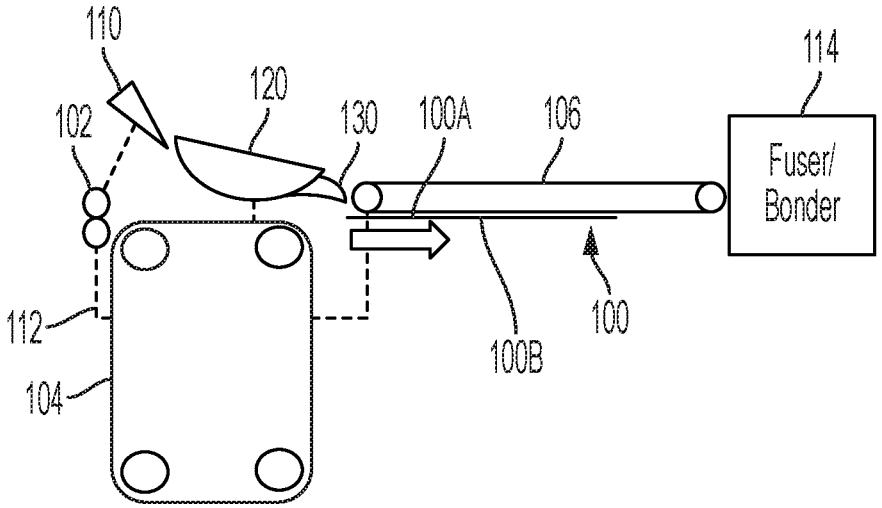
Figure 2A:
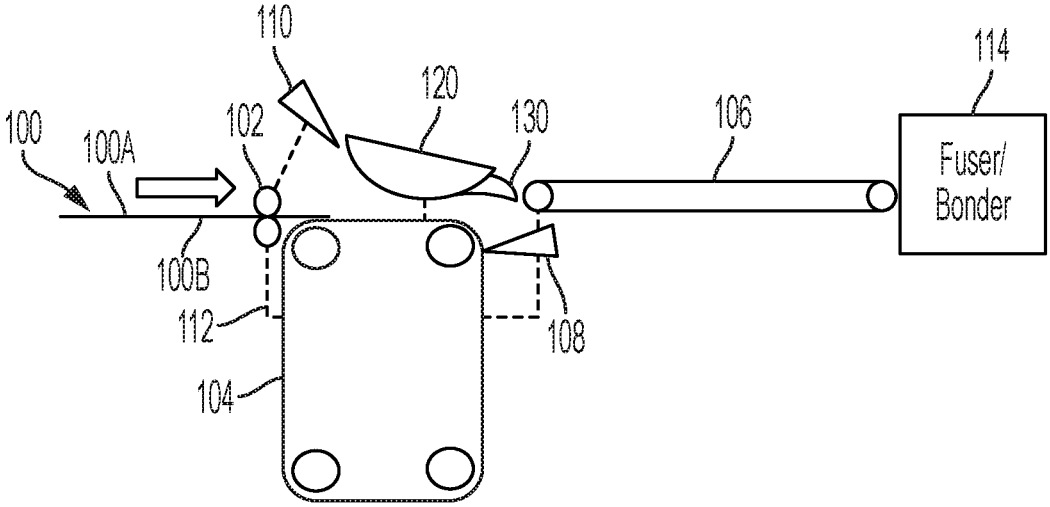
Figure 2B:
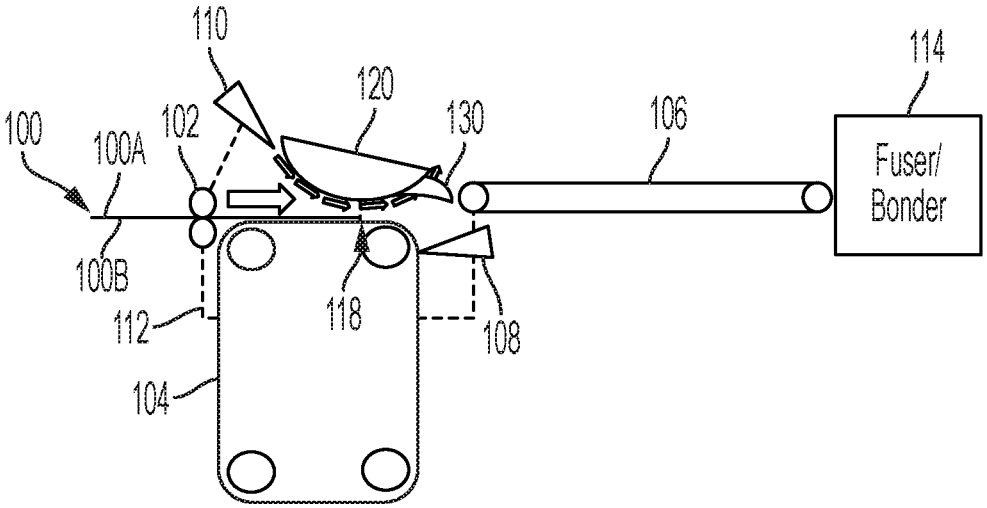
Figure 2C:
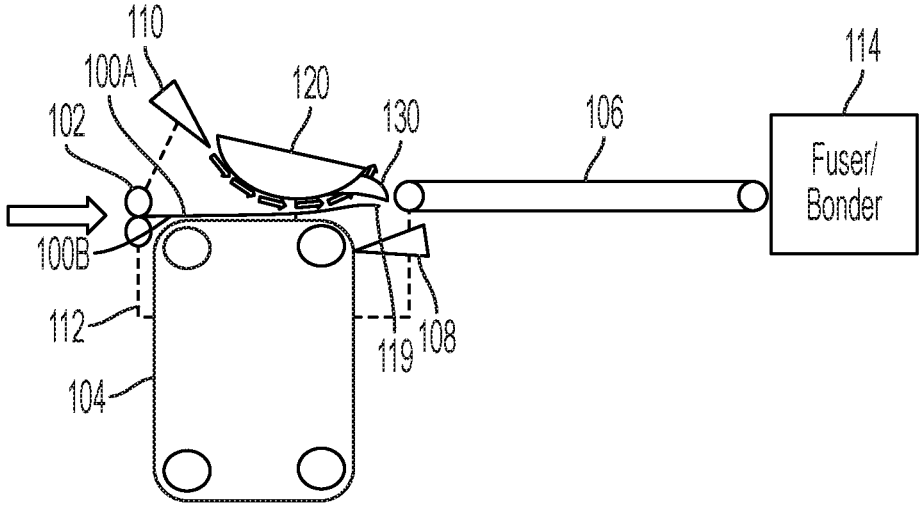
Figure 2D:
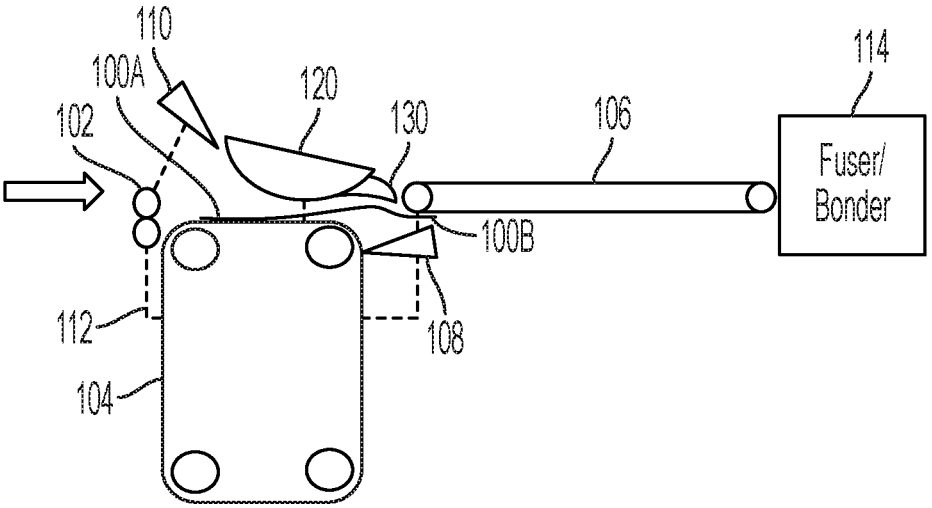
Figure 2E:
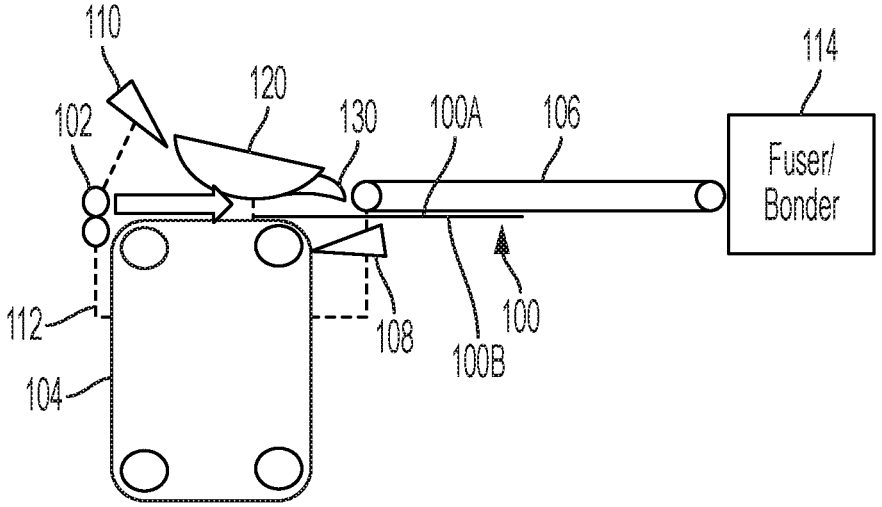
Figure 2F:
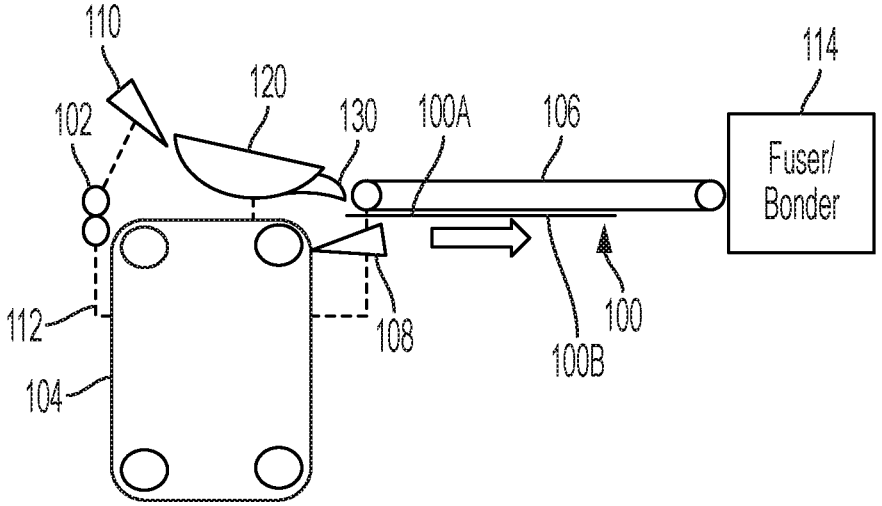

Therefore, as shown in FIGS. 1E and 1F, the high-pressure stream of air no longer flows along the curve surface of the baffle 120 (as indicated by the lack of arrows in FIGS. 1E and 1F). However, at this point the lifting force is no longer needed because the transport device 106 has sufficiently established a grasp on the sheet of media 100. Additionally, the stream of air is discontinued as soon as possible to reduce the possibility that the stream of air might pass underneath the trailing edge of the sheet of media 100, which might undesirably disturb the unfused marking material present on the printing side 100B of the sheet of media 100.

The flow shown in FIGS. 1A-1F demonstrates that the stream of air is highly controlled to provide only the amount of lift needed, and only for the processing period when needed. Specifically, as shown in FIGS. 1B-1D, the air outlet 110 is adapted to begin outputting the stream of air only when the leading edge of the sheet of media 100 is adjacent the maximum lifting point 118 (where the baffle 120 is closest to the transfer surface 104). The air outlet 110 is adapted to continuously output the stream of air from when the leading edge is adjacent the maximum lifting point 118, only until when the leading edge makes contact with the transport device 106, at which processing point the air outlet 110 stops outputting the stream of air.

The processing points for beginning and ending the stream of air can vary for different beam strength media and for different machine designs. Once again, a feature of devices and methods herein is that the stream of the air is minimized at all times to reduce the chance of disturbing the marking material on the printing side 100B of the sheets. In order to produce this feature, the devices and methods herein automatically determine the beam strength of the sheets 100 on the transfer surface 104 and, based on this automatically determined beam strength, change the force (e.g., pressure, velocity, etc.) of the stream of air and/or change the processing period (processing length, processing span, processing time period) in which the stream of air is applied to the back side 100A of the sheets 100.

Therefore, in some situations, the air outlet 110 can be adapted to output the stream of air beginning when the leading edge of the sheets of media 100 reaches the maximum lifting point 118 (or before or after this processing point), depending upon the then-current beam strength of the sheets. Additionally, the force (e.g., pressure, velocity, etc.) of the stream of air can be altered depending upon the then-current beam strength of the sheets.

In the realm of sheets, beam strength is known to mean, for example, the tendency for an unsupported sheet to maintain, or return to, a flat state. For purposes herein, beam strength is considered a sheet's own unsupported, unaided ability to self-release from a curved surface so as to maintain a flat state on its own and proceed to a next processing component (e.g., the transport device 106) without being manipulated by other components. Higher beam strengths correspond to a greater ability to self-release from a curved surface, while lower beam strengths correspond to the opposite. The beam strength will vary depending upon the weight (e.g., g/cm$^2$), stiffness, length, etc., of the sheets, as well as the environmental conditions (humidity, temperature, etc.). Therefore, the very same sheet (same type, weight, length, etc.) may have a higher beam strength in one environment (e.g., lower humidity) and a lower beam strength in a different environment (e.g., higher humidity).

The distinction between a relatively lower beam strength sheet and a relatively higher beam strength sheet varies based upon the different environmental conditions, sheet conditions, machine conditions, etc. Therefore, no absolute measures of beam strengths are presented here. Instead, broadly a relatively higher being strength is higher than a relatively lower beam strength, with a medium beam strength being between the two.

The beam strength of sheets 100 attached to the transfer surface 104 can be automatically determined using various sensors (discussed below) and/or can be determined from manual input supplied by the user through the device's user interface. Knowing the current beam strength of the sheets 100 being processed is a useful item of information because the geometry of the transfer surface 104 is commonly established to create a corner to assist the sheet in self-releasing from the transfer surface. In some examples, the transfer service is a drum and the sheet of media is intended to only contact a single linear point or linear area of the drum and then immediately release therefrom (e.g., the sheet is intended to always remain linear as it comes in contact with, and leaves, the drum, based on a sufficiently high beam strength).

In the belt-type transfer surface 104 examples shown in the attached drawings, the transfer surface 104 has a planar portion that is linear and is approximately parallel to (and potentially co-planar with) an aligned planar portion of the transport device 106. The transfer surface 104 also includes a corner at the end of this planar portion where the transfer surface makes an abrupt turn in order to run in a direction approximately perpendicular to the previous planar portion (e.g., potentially where the transfer surface 104 is supported by a roller or other similar device). At this corner of the transfer surface 104, the beam strength of the sheets 100 biases the sheets 100 to remain straight and linear (flat) which causes the sheet 100 to self-separate from the transfers surface 104. Again, higher beam strength sheets will have a greater tendency to self-separate from the curve of the transfer surface 104, relative to relatively lower beam strength sheets.

In view of this, the methods and devices herein can optionally automatically and constantly determine the then-current beam strength of the sheets 100 as they are being processed along the transfer surface 104. Note, again, that the beam strength of the exact same sheets can change based on changing internal environmental conditions within the printing device. Thus, for relatively higher beam strength sheets, a reduced stream of air is applied to the back side of the sheets 100. This reduced stream of air can have a lower pressure, lower velocity, and/or can be applied during a shorter processing period (e.g., by beginning the stream of air a set distance after the leading edge of the sheet 100 passes the maximum lifting point 118). In some situations, for a sufficiently high beam strength, the stream of air may not be applied at all.

In contrast, for relatively lighter beam strength sheets (e.g., ultra-lightweight sheets) which have a greater tendency to remain attached to the transfer surface 104, an increased stream of air is applied to the sheet's 100 back side 100A. Correspondingly, this increased stream of air can have a higher pressure, higher velocity, and/or can be applied during a longer processing (e.g., by beginning the stream of air a set distance before the leading edge of the sheet 100 passes the maximum lifting point 118) all such increases being relative to those of the reduced stream of air.

FIGS. 2A-2F illustrate a similar structure and flow as that shown in FIGS. 1A-1F (and a redundant discussion of the components described above is avoided here for brevity and reader focus); however, in FIGS. 2A-2F such devices can include a mechanical stripper device 108. The mechanical stripper device 108 is adjacent the transfer surface 104 on the printing side 100B of the sheets of media 100. Also, the mechanical stripper device 108 can be positioned to contact the sheets of media 100 if the sheets of media 100 do not self-separate from the transfer surface 104.

The mechanical stripper device 108 can be any form of physical device that includes a lifting surface or linear projection, and can be at least as wide as the sheets 100. The mechanical stripper device 108 is shaped and positioned to contact the leading edge of the sheets 100 as they pass, so as to physically lift the sheets from the transfer surface 104, if needed. For example, the stripper device 108 can be a linear flat structure that has at least one side that forms a narrow lifting edge (e.g., knife edge). This narrow lifting edge faces the transfer surface 104 and is close enough to the transfer surface 104 to physically contact the leading edge of the sheet 100 that is attached to the transfer surface 104 in order to lift or peel the sheets off the transfer surface 104. The mechanical stripper device 108 avoids touching the transfer surface 104 to avoid excess wear.

Similar to the flow of FIGS. 1A-1F discussed above, in the flow of FIGS. 2A-2F, the air outlet 110 can also be adapted to begin outputting the stream of air when the leading edge of the sheets of media 100 reaches the maximum lifting point. However, in the flow of FIGS. 2A-2F, rather than waiting until when the leading edge of the sheets of media 100 reaches the sheet transport device 106 to stop the stream of air, instead in the flow of FIGS. 2A-2F the stream of air can be stopped when the leading edge of the sheet 100 reaches the mechanical stripper device 108 (relying upon the mechanical stripper device 108 to perform any needed additional stripping action). More specifically, the stream of air can be stopped when the leading edge of the sheet 100 reaches a point aligned with (e.g., in a vertical direction perpendicular to the horizontal processing direction) the closest end (e.g., most upstream end relative to the processing direction) of the mechanical stripper device 108 (e.g., when the sheet reaches a point above the part of the mechanical stripper device 108 that is closest to the transfer surface 104).

Thus, the flow shown in FIGS. 2A-2F even more restrictively controls the processing span when the stream of air is provided, to again reduce any likelihood that the marking material on the printing side 100B of the sheets 100 will be disturbed. In other words, by stopping the stream of air when the leading edge of the sheets 100 reaches an area above the closest end of the mechanical stripper device 108 (instead of waiting until the leading edge of the sheets 100 reaches all the way to the sheet transport device 106), less airflow occurs along the back side of the sheets 100, reducing the likelihood that the stream of air will disturb the marking material on the printing side 100B of the sheets 100. Again, the processing points for beginning and ending the stream of air, as well as the force (e.g., pressure, velocity, etc.) of the stream of air, are changed by the devices and methods herein for different beam strength media and for different machine designs even if a mechanical stripper 108 is used.

Figure 3A:
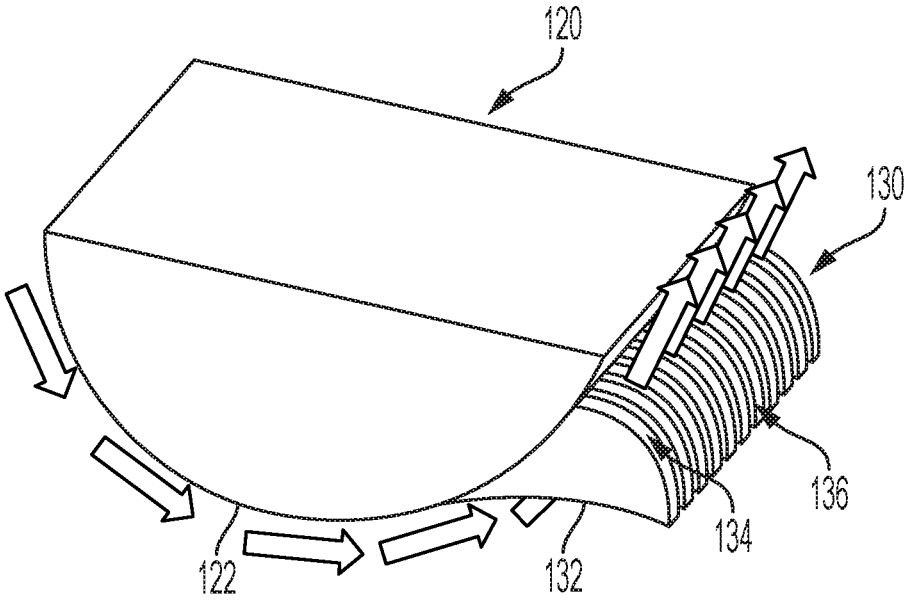
FIGS. 3A-3B are perspective-view schematic diagrams illustrating a baffle and a sheet deflector of stripping devices herein.
Figure 3B:
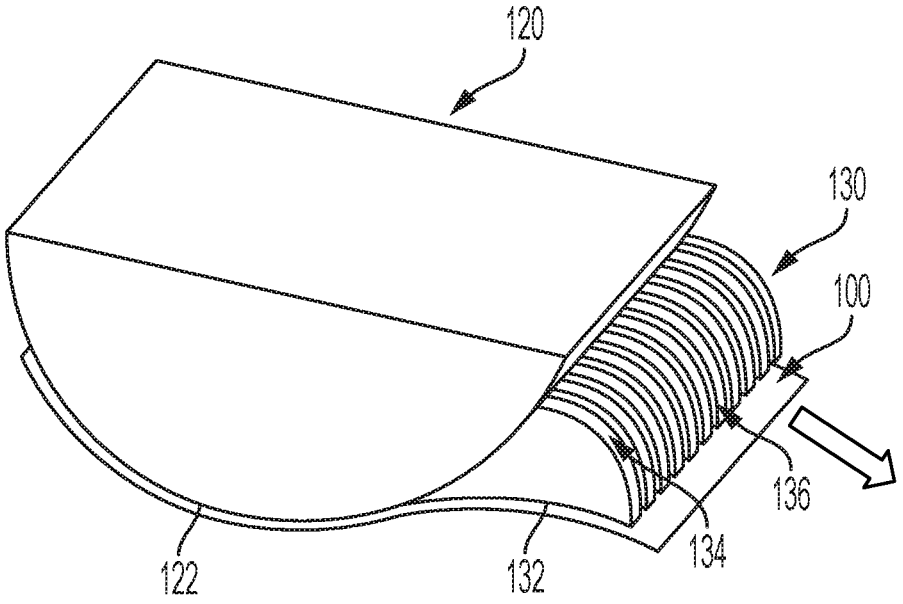

More details of the baffle 120 and sheet deflector 130 are shown in the expanded, perspective views shown in FIGS. 3A-3B. Specifically, FIGS. 3A-3B illustrate that the baffle 120 has a generally continuous convex curved surface 122 facing the sheets of media 100 and the transfer surface 104. In one example, the surface 122 of the baffle 120 that faces the transfer surface 104 can be a fully-curved, continuous, constant radius, unbroken single arc shape, without linear portions, that forms a convex shape extending outward toward the transfer surface 104 with a single, discrete location (pointed to by identification numeral 118) that is closest to the transfer surface 104. As shown in FIGS. 1A-2F, the air outlet 110 is positioned relative to the convex curved surface 122 of the baffle 120 to direct the stream of air (again shown using block arrows in FIG. 3A) along the convex curved surface 122 of the baffle 120.

FIG. 3A also uses block arrows to show that the sheet deflector 130 includes air slots 136 through which the stream of air can pass. FIG. 3B shows that the sheets of media 100 cannot pass through the sheet deflector 130. Instead, the sheet deflector 130 includes a concave surface 132 of ribs facing the sheets 100 and the transfer surface 104, which directs/deflects the sheets of media 100 from the surface of the baffle 120 to the transport device 106. A convex surface 134 of the sheet deflector 130 is opposite the concave surface 132 of the sheet deflector 130. Note that the air slots 136 are formed fully through the sheet deflector from the concave surface 132 to the convex surface 134.

As noted above, the sheet deflector 130 is positioned between the baffle 120 and the transport belt 106 and can be attached to the baffle 120 or can be formed as an integral part of the baffle 120. As shown in FIGS. 3A-3B, the sheet deflector 130 allows the stream of air to fully follow and exit from the curved surface of baffle 120, but prevents the sheets 100 from fully following the curved surface of the baffle 120 to the end, causing the sheets 100 be fed to the sheet transport device 106. For example, the sheet deflector 130 may cover the last (in the processing direction) 40%, 30%, 20%, etc., of the curved surface of baffle 120.

Figure 4:
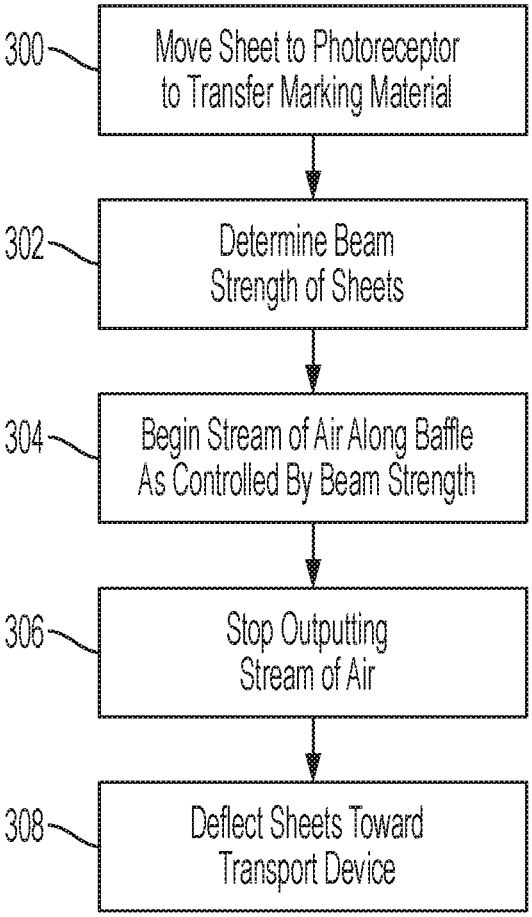
FIG. 4 is a flow diagram of various methods herein.

FIG. 4 is flowchart illustrating exemplary methods herein. In item 300, these methods move the sheets to make contact with the transfer surface to transfer marking material to the printing side of sheets of media. In item 302, these methods automatically determine the beam strength of the sheets of media.

In item 304, such methods begin directing a stream of air along the baffle by opening or turning on the air outlet. As noted above, the baffle is adjacent the back side of the sheets of media that is opposite to the printing side of the sheets of media. Also, the process of directing the stream of air directs the stream of air along the convex curved surface of the baffle.

The process of beginning the stream of air in item 304 is controlled (e.g., by the processor) to begin at different processing points (or possibly not begin) based on the beam strength of the sheets. As noted above, the process of beginning the stream of air in item 304 can occur when the leading edge of the sheets is at the maximum lifting point (lowest point of the baffle), or before or after the maximum lifting point, depending upon the then-current beam strength. Similarly, the process of beginning the stream of air in item 304 is controlled (e.g., by the processor) to adjust the force (e.g., pressure, velocity, etc.) of the stream of air differently for different beam strength media.

In item 306, these methods stop outputting the stream of air by closing or turning off the air outlet. In item 306, these methods can stop outputting the stream of air when the leading edge of the sheet of media contacts the transport device, or when the leading edge of the sheet of media reaches the optional mechanical stripper device, if used.

Also, as shown in item 308, such methods can prevent the sheets of media from following the full surface of the baffle using the sheet deflector and this completes the process of moving the sheets of media from the transfer surface across the gap to the transport belt in a processing direction.

Figure 5:
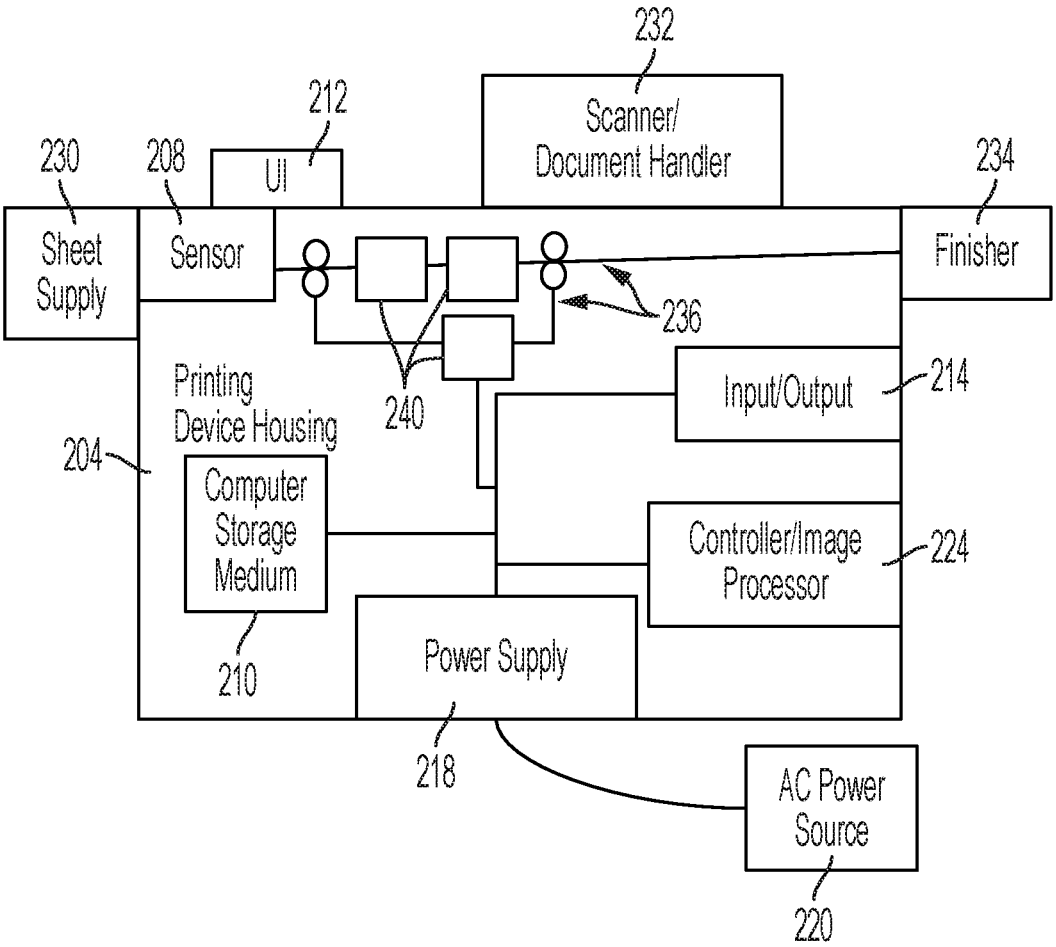
FIG. 5 is a schematic diagram illustrating devices herein.

FIG. 5 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a user interface (UI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 5, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that use marking material, and are operatively connected to a specialized image processor 224 (that can be different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

As noted above, one or more sensors 208 can be directly or indirectly connected to the processor 224. The sensor 208 can detect information used by the processor 224 to automatically calculate the beam strength of the sheets (or such information can be manually entered through the user interface 212). For example, the sensor 208 (which can be, or include, multiple sensors of different types) can automatically detect the length of the media (media length sensor(s)), the weight of the media (media thickness/weight per area sensor), the humidity (hygrometer), temperature (thermometer), and/or other environmental conditions within the stacking device, etc.

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

Therefore, the processor 224 controls at least the roller nip 102 and the transfer surface 104 to move the sheets 100 to make contact with the transfer surface 104 to transfer marking material to the printing side 100B of sheets of media 100. The processor 224 also automatically determines the beam strength of the sheets of media 100. The processor 224 controls the air outlet 110 to begin directing the stream of air along the baffle 120 at different processing points (or possibly not begin) based on the beam strength of the sheets 100. As noted above, the process of beginning the stream of air in item 304 can occur when the leading edge of the sheet 100 is at the maximum lifting point (lowest point of the baffle 120), or before or after the maximum lifting point, depending upon the beam strength. Similarly, the processor 224 controls the air outlet 110 to adjust the force (e.g., pressure, velocity, etc.) of the stream of air differently for different beam strength media. The processor 224 controls the air outlet 110 to stop outputting the stream of air when the leading edge of the sheet 100 of media contacts the transport device, or when the leading edge of the sheet 100 of media reaches the optional mechanical stripper device.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

a photoreceptor adapted to contact and transfer marking material to a printing side of sheets of media;

a transport device adjacent the photoreceptor, wherein the sheets of media are moved by the photoreceptor across a gap to the transport device in a processing direction;

a baffle, wherein the baffle is adjacent a back side of the sheets of media that is opposite to the printing side of the sheets of media; and an air outlet, wherein the air outlet is positioned adjacent the back side of the sheets of media, and wherein the air outlet is adapted to direct a stream of air along the baffle and between the baffle and the back side of the sheets of media.

2. The apparatus according to claim 1, further comprising a processor operatively connected to the air outlet, wherein the processor controls the air outlet to adjust a force and duration of the stream of air based on a beam strength of the sheets of media.

3. The apparatus according to claim 1, wherein the air outlet is adapted to begin outputting the stream of air when a leading edge of the sheets of media is adjacent the baffle and to stop outputting the stream of air when a leading edge of the sheets of media contacts the transport device.

4. The apparatus according to claim 1, further comprising a mechanical stripper device adjacent the photoreceptor on the printing side of the sheets of media, wherein the air outlet is adapted to begin outputting the stream of air when a leading edge of the sheets of media is adjacent the baffle and to stop outputting the stream of air when a leading edge of the sheets of media reaches the mechanical stripper device.

5. The apparatus according to claim 1, further comprising a sheet deflector connected to the baffle, wherein the sheet deflector includes air slots through which the stream of air can pass, and wherein the sheet deflector is positioned between the baffle and the transport device.

6. The apparatus according to claim 1, wherein the baffle has a convex curved surface facing the back side of the sheets of media.

7. The apparatus according to claim 6, wherein the air outlet is positioned relative to the convex curved surface of the baffle to direct the stream of air along the convex curved surface of the baffle.

8. A printing apparatus comprising:

a frame;

a transfer surface directly or indirectly connected to the frame, wherein the transfer surface is adapted to contact and transfer marking material to a printing side of sheets of media;

a transport device directly or indirectly connected to the frame, wherein the transport device is adjacent the transfer surface, wherein a gap is present between the transfer surface and the transport device, and wherein the sheets of media are moved by the transfer surface across the gap to the transport device in a processing direction;

a curved baffle directly or indirectly connected to the frame, wherein the curved baffle is adjacent a back side of the sheets of media that is opposite to the printing side of the sheets of media; and an air outlet directly or indirectly connected to the frame, wherein the air outlet is positioned adjacent the back side of the sheets of media, and wherein the air outlet is adapted to direct a stream of air along the curved baffle and between the curved baffle and the back side of the sheets of media.

9. The apparatus according to claim 8, further comprising a processor operatively connected to the air outlet, wherein the processor controls the air outlet to adjust a force and duration of the stream of air based on a beam strength of the sheets of media.

10. The apparatus according to claim 8, wherein the air outlet is adapted to begin outputting the stream of air when a leading edge of the sheets of media is adjacent the curved baffle and to stop outputting the stream of air when a trailing edge of the sheets of media contacts the transport device.

11. The apparatus according to claim 8, further comprising a mechanical stripper device adjacent the transport device on the printing side of the sheets of media, wherein the air outlet is adapted to begin outputting the stream of air when a leading edge of the sheets of media is adjacent the curved baffle and to stop outputting the stream of air when a leading edge of the sheets of media reaches the mechanical stripper device.

12. The apparatus according to claim 8, further comprising a sheet deflector connected to the curved baffle, wherein the sheet deflector includes air slots through which the stream of air can pass, and wherein the sheet deflector is positioned between the curved baffle and the transport device.

13. The apparatus according to claim 8, wherein the curved baffle has a convex curved surface facing the back side of the sheets of media.

14. The apparatus according to claim 13, wherein the air outlet is positioned relative to the convex curved surface of the curved baffle to direct the stream of air along the convex curved surface of the curved baffle.

15. A printing method comprising:

transferring marking material to a printing side of sheets of media using a photoreceptor;

moving the sheets of media from the photoreceptor across a gap to a transport device in a processing direction; and directing a stream of air toward a baffle using an air outlet, wherein the baffle is adjacent a back side of the sheets of media that is opposite to the printing side of the sheets of media.

16. The method according to claim 15, wherein the directing the stream of air comprises adjust a force and duration of the stream of air based on a beam strength of the sheets of media.

17. The method according to claim 15, wherein the directing the stream of air comprises beginning outputting the stream of air when a leading edge of the sheets of media is adjacent the baffle and stopping outputting the stream of air when a leading edge of the sheets of media contacts the transport device.

18. The method according to claim 15, wherein the directing the stream of air comprises outputting the stream of air beginning when a leading edge of the sheets of media is adjacent the baffle and stopping outputting the stream of air when a leading edge of the sheets of media reaches a mechanical stripper device.

19. The method according to claim 15, further comprising preventing the sheets of media from following a surface of the baffle using a sheet deflector connected to the baffle, wherein the sheet deflector includes air slots through which the stream of air can pass, and wherein the sheet deflector is positioned between the baffle and the transport device.

20. The method according to claim 15, wherein the directing the stream of air comprises directing the stream of air along a convex curved surface of the baffle.

* * * * *